US006609470B2

(12) United States Patent
Perego et al.

(10) Patent No.: US 6,609,470 B2
(45) Date of Patent: Aug. 26, 2003

(54) SEWING MACHINE FOR FORMING RUNNING-STITCH SEAMS WITH HIGH SEWING RELIABILITY

(75) Inventors: Ferruccio Perego, Milan (IT); Mario Valle, Pavia (IT)

(73) Assignee: Conti Complett S.p.A., Milan (IT)

( * ) Notice: Subject to any disclaimer, the term of this patent is extended or adjusted under 35 U.S.C. 154(b) by 0 days.

(21) Appl. No.: 10/025,746

(22) Filed: Dec. 26, 2001

(65) Prior Publication Data

US 2002/0092452 A1 Jul. 18, 2002

(30) Foreign Application Priority Data

Jan. 15, 2001 (IT) ..... MI2001A0064

(51) Int. Cl.[7] ..... D05B 01/04
(52) U.S. Cl. ..... 112/173; 112/201
(58) Field of Search ..... 112/248, 201, 112/189, 181, 173, 227, 261, 222, 224, 187

(56) References Cited

U.S. PATENT DOCUMENTS 18,522 A * 10/1857 Roper
3,238,903 A * 3/1966 Pav
4,122,787 A * 10/1978 Conti
4,974,758 A * 12/1990 Wunsch

FOREIGN PATENT DOCUMENTS

JP 57 034887 2/1982

OTHER PUBLICATIONS

Patent Abstracts of Japan vol. 1998, No. 03, Feb. 27, 1998 & JP 09 294883 A (Juki Corp; Takatori Corp), Nov. 18, 1997 *abstract; figures*.

Patent Abstracts of Japan vol. 1997, No. 10, Oct. 31, 1997 & JP 09 164280 A (Ozawa Goro), Jun. 24, 1997 *abstract; figures*.

* cited by examiner

*Primary Examiner*—Ismael Izaguirre
(74) *Attorney, Agent, or Firm*—Guido Modiano; Albert Josif; Daniel O'Byrne

(57) ABSTRACT

A sewing machine for forming running-stitch seams, comprises a needle provided with an open eye and orientated with the axis substantially perpendicular to a surface for supporting the sewn item and is actuated with a reciprocating motion to pass cyclically through the supporting surface. A thread take-up wheel, provided below the supporting surface, is composed of a fixed part, with a magazine for the taken-up thread, and a rotatable part, rotationally actuated about its own axis. The rotatable part supports a lower looper engaging a portion of the loop that protrudes from the eye along one side of the needle. A thread disengager is provided for disengaging the thread from the needle which engage the portion of the loop of thread protruding from the eye.

9 Claims, 3 Drawing Sheets

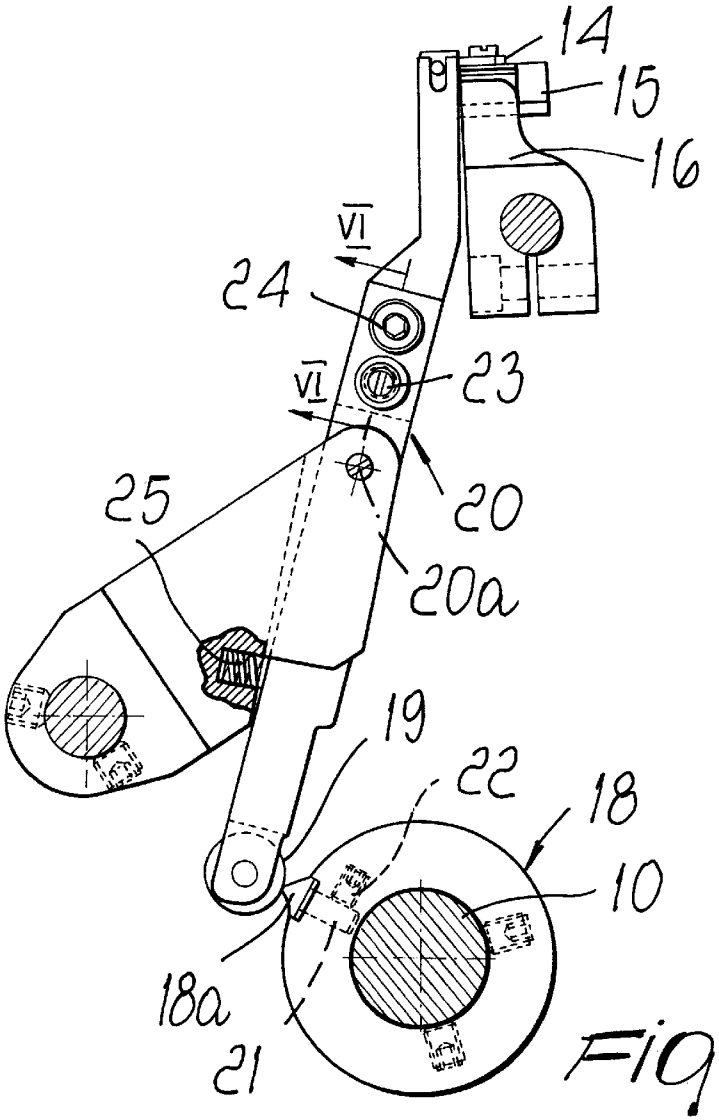
Fig. 5
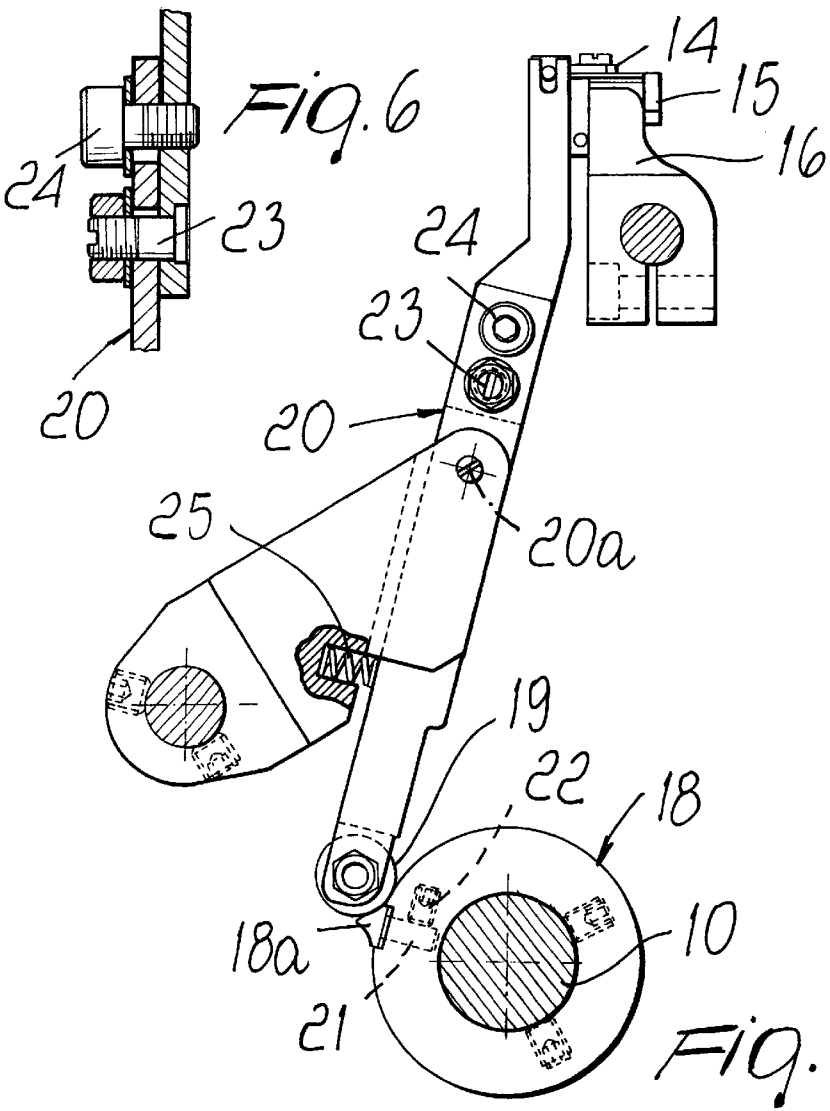
Fig. 4
Fig. 6

SEWING MACHINE FOR FORMING RUNNING-STITCH SEAMS WITH HIGH SEWING RELIABILITY

BACKGROUND OF THE INVENTION

The present invention relates to a sewing machine for forming running-stitch seams.

Sewing machines for forming a seam with a so-called running stitch are known; such seam is formed with a single thread of preset length, known as draw, and is composed of stitches that are alternately visible on either side of the fabric being sewn.

A machine of this kind is disclosed in U.S. Pat. No. 4,122,787 and is substantially composed of a needle that has a substantially vertical axis and is provided, proximate to its tip, with an open eye and is orientated so that its axis is substantially perpendicular to a supporting surface on which the item being sewn is deposited.

The needle can be actuated with a reciprocating motion along its axis in order to pass cyclically through the item deposited on the supporting surface. Below the supporting surface there is a thread take-up wheel, which is arranged on a plane that is substantially parallel to the axis of the needle and is orientated so that its axis is substantially perpendicular to the axis of the needle. Such wheel is composed of a fixed part, in which there is a magazine for the taken-up thread, and a rotatable part, which can be actuated with a rotary motion about its own axis. The rotatable part of the wheel is mounted coaxially on an actuation shaft, which can be rotationally actuated about its own axis synchronously with the movement of the needle, and has, in a peripheral region, a looper or lower looper which, as a consequence of the rotation of the rotatable part of the wheel and of the movement of the needle, engages the thread carried below the supporting surface by the needle and takes it up, making it pass inside the magazine provided in the fixed part of the wheel.

The machine is completed by thread handling elements, which are located below the supporting surface, and by another looper, or upper looper, which is arranged above the supporting surface laterally to the needle and is designed to engage the loop of thread carried by the needle above the supporting surface and retain it while it is taken up by the lower looper.

Substantially, this machine works with a draw of thread that is clamped at one of its ends. During a first step of the operating cycle, the needle, threaded with the thread proximate to its clamped end, passes through the item being sewn, carrying a loop of thread below the supporting surface.

Such loop of thread is engaged by the lower looper as a consequence of the rotation of the rotatable part of the wheel, and all the excess thread of the draw is loaded into the magazine located in the fixed part of the wheel and disengaged from the needle, which is extracted above the supporting surface.

After the item being sewn has been advanced by one step, the needle descends again with its eye below the supporting surface and engages the thread, carrying in the subsequent return step a loop of thread above the item being sewn. This loop of thread is engaged by the upper looper and, after the item has been advanced by another step, the needle again passes through the item, carrying a loop of thread below the supporting surface. Such loop of thread is engaged by the lower looper and disengaged from the needle. The lower looper, by continuing its rotation, takes up the portion of thread that lies between the eye of the needle and the free end of the draw, extracting it and reloading it into the magazine of the fixed part of the wheel. In this manner, the machine produces a seam with a single thread composed of stitches that are alternatively visible on the outer side and inner side of the item being sewn, i.e. a seam formed with so-called running stitches.

In these machines, when the item being sewn is rigid or in any case such as to cause high friction on the sewing thread, for example in the case of hides or leather-like synthetic materials, the disengagement of the loop of thread from the open eye of the needle due to the action of the lower looper can be difficult and the thread can break due to the friction of the thread against the upper edge of the eye of the needle.

SUMMARY OF THE INVENTION

The aim of the present invention is to solve the above problems by providing a sewing machine for forming running-stitch seams that can sew correctly even rigid items or items that produce high friction on the sewing thread.

Within this aim, an object of the invention is to provide a sewing machine for forming running-stitch seams that effectively avoids breakage of the sewing thread during its disengagement from the eye of the needle.

Another object of the invention is to provide a sewing machine that can be obtained, with modifications that are relatively simple to provide and at a low cost, from known types of sewing machine for forming running-stitch seams.

This aim and these and other objects that will become better apparent hereinafter are achieved by a sewing machine for forming running-stitch seams, comprising a needle provided, proximate to its tip, with an open eye and orientated so that its axis is substantially perpendicular to a surface for supporting the item being sewn, said needle being actuatable with a reciprocating motion along its own axis in order to pass cyclically through said supporting surface; a thread take-up wheel being provided below said supporting surface, being arranged on a plane that is substantially parallel to the axis of said needle and being orientated so that its axis is substantially perpendicular to the axis of said needle; said wheel being composed of a fixed part, in which there is a magazine for the taken-up thread, and a rotatable part, which can be rotationally actuated about its own axis; said rotatable part of the wheel being mounted coaxially on an actuation shaft that can be rotationally actuated about its own axis synchronously with the movement of said needle and being provided with a lower looper that can engage a portion of the loop of thread that protrudes from said eye along one side of said needle; characterized in that it comprises means for disengaging the thread from said needle that can be engaged with the portion of the loop of thread that protrudes from said eye along the other side of the needle and can move in order to assist said lower looper in the disengagement of said loop of thread from the eye of the needle.

BRIEF DESCRIPTION OF THE DRAWINGS

Further characteristics and advantages of the invention will become better apparent from the description of a preferred but not exclusive embodiment of the machine according to the invention, illustrated only by way of non-limitative example in the accompanying drawings, wherein:

FIGS. 4 and 5 are sectional views, taken along the line IV—IV of FIG. 1, of the operation of the thread disengagement means;

FIG. 6 is a sectional view of a detail of FIG. 5, taken along the line VI—VI.

DESCRIPTION OF THE PREFERRED EMBODIMENTS

Figure 1:
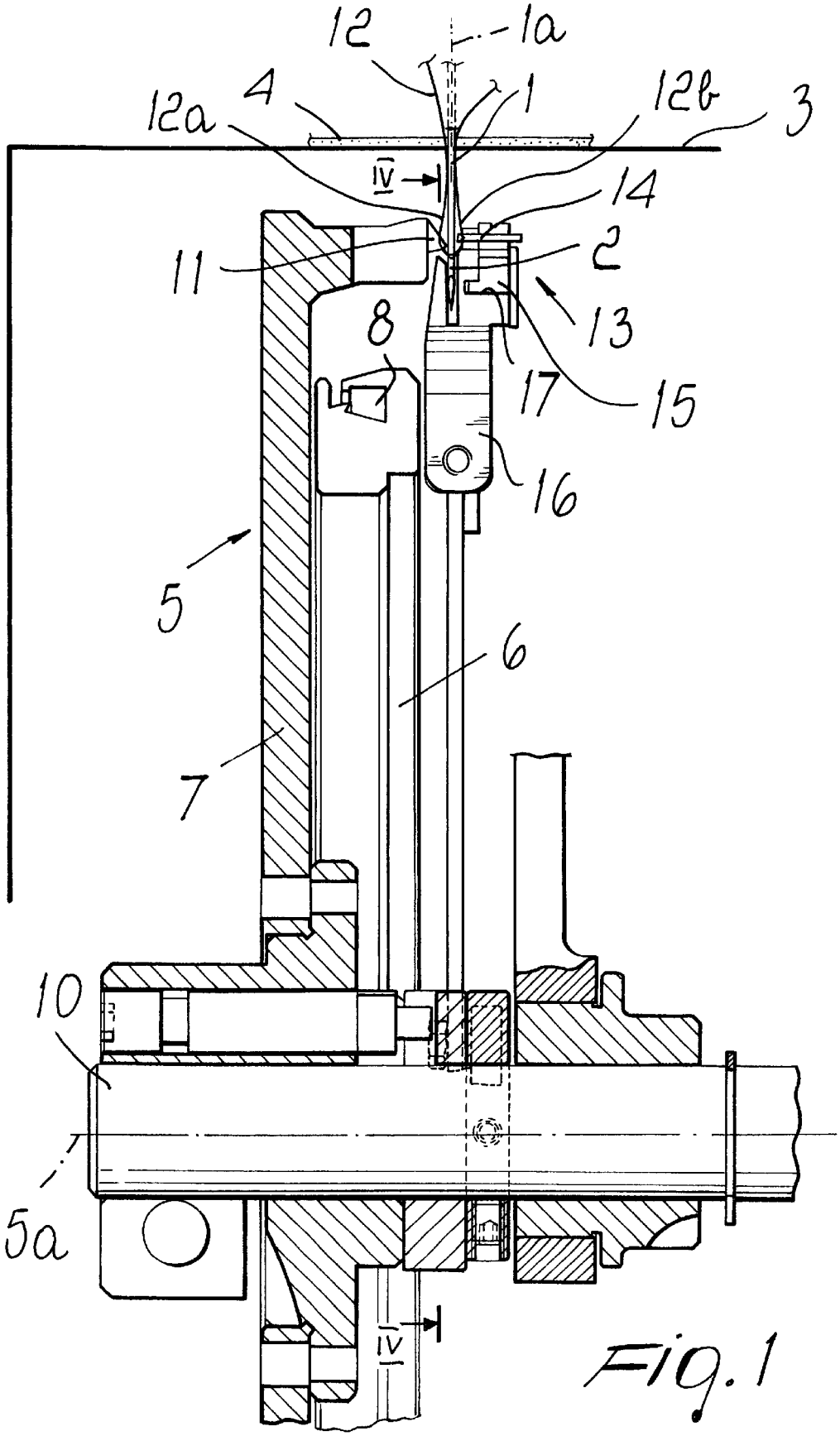
FIG. 1 is a partially sectional front elevation view of the part of the machine that is located below the surface that supports the item to be sewn.
Figure 3:
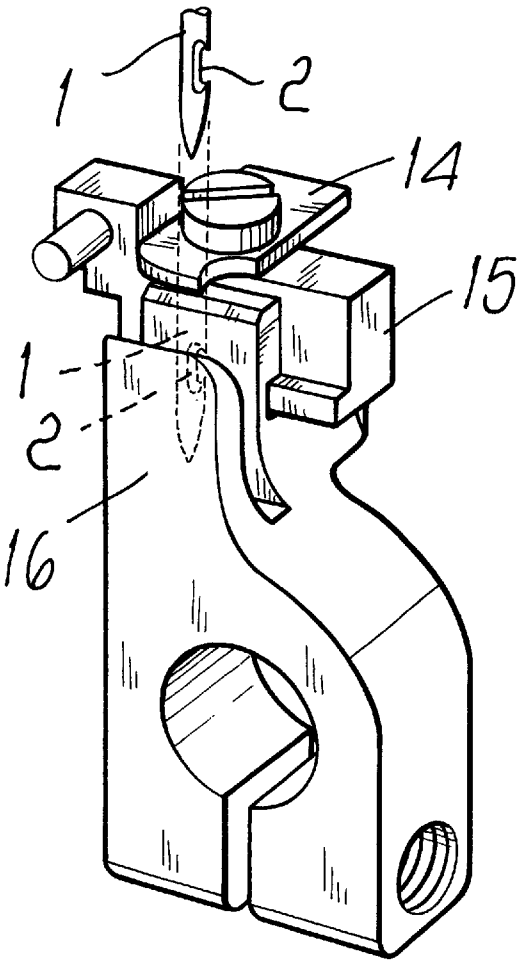
FIG. 3 is an enlarged-scale perspective view of the thread disengagement means and of the needle.
Figure 2:
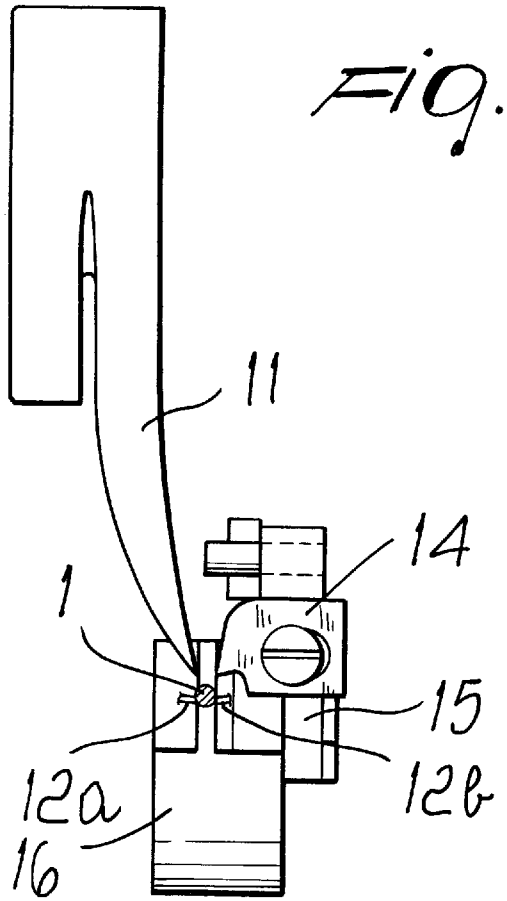
FIG. 2 is a top plan view of the needle, the lower looper and the thread disengagement means.

With reference to the figures, the machine according to the invention, shown only partially for the sake of simplicity, comprises in a per se known manner a needle 1 that has, proximate to its tip, an eye 2 that is open at the front and is orientated so that its axis la is substantially perpendicular to a supporting surface 3 for the item 4 being sewn.

The needle 1 can be actuated with a reciprocating motion along its axis 1*a,* which is preferably orientated vertically, in order to pass cyclically through the supporting surface 3, which is preferably arranged horizontally.

Below the supporting surface 3 there is a thread take-up wheel, generally designated by the reference numeral 5, which is arranged on a plane that is substantially parallel to the axis 1*a* of the needle 1 and is orientated so that its axis 5*a* is substantially perpendicular to the axis 1*a* of the needle 1.

The wheel 5 is composed of a fixed part 6 and a rotatable part 7, which can be rotationally actuated about the axis 5*a*. The fixed part 6 of the wheel 5 has a discontinuity along its circumferential contour, and in its peripheral region there is a magazine 8 for the taken-up thread. The rotatable part 7 of the wheel is mounted coaxially on an actuation shaft 10, which can be rotationally actuated about its own axis, which coincides with the axis 5*a,* synchronously with the movement of the needle 1. The rotatable part 7 supports a looper 11, which constitutes the lower looper of the machine and can engage a portion 12*a* of the thread 12 that protrudes from the eye 2 along one side of the needle 1 when the thread 12 is carried by the needle 1 below the supporting surface 3 after passing through the item 4 being sewn, which rests on the supporting surface 3.

According to the invention, the sewing machine comprises means 13 for disengaging the thread 12 from the needle 1 that can engage the portion 12*b* of the loop of thread 12 that protrudes from the eye 2 along the other side of the needle 1 and can move in order to assist the lower looper 11 in disengaging the loop of thread 12 from the eye 2 of the needle 1.

Preferably, the disengagement means 13 comprises a thread pusher plate 14 arranged below the supporting surface 3 laterally to the path followed by the needle 1 in its reciprocating motion along its own axis 1*a,* on the opposite side with respect to the lower looper 11.

The thread pusher plate 14 has a hook-shaped portion that is designed to engage the thread and is fixed to a block 15, which is supported by a supporting element fixed to the supporting structure of the machine so that it can slide along a direction that is substantially perpendicular to the axis 1*a* of the needle 1 and parallel to the plane of arrangement of the wheel 5. The supporting element is preferably constituted by the needle protection plate 16 with which known types of sewing machine are equipped, appropriately modified by forming therein a guide 17 for the sliding of the block 15.

The thread pusher plate 14 is kinematically connected to the lower looper 11 so that the movement of the thread pusher plate 14 is synchronized with the movement of the lower looper 11 and with the movement of the needle 1.

More particularly, the movement of the thread pusher plate 14 is achieved by means of an eccentric cam 18, which is keyed on the same actuation shaft 10. A cam follower roller 19 engages the profile of the cam 18 and is supported by one end of a lever 20 that acts, with its other end, on the thread pusher plate 14.

The lever 20 is pivoted, with an intermediate portion, to the supporting structure of the machine about an axis 20*a* that is parallel to the axis 5*a* of the actuation shaft 10.

The cam 18 has an eccentric portion 18*a* that produces the rotation of the lever 20 about the axis 20*a*.

The contact between the eccentric cam 18 and the cam follower roller 19 is maintained by means of a spring 25 that is interposed between a portion of the lever 20 that is spaced from the axis 20*a* and the supporting structure of the machine.

Advantageously, the eccentric portion 18*a* is mounted on a pivot 21, which can be moved radially in the cylindrical body of the cam 18 and can be locked in the chosen position, for example by means of a grub screw 22. In this manner it is possible to vary the distance of the eccentric portion 18*a* from the axis 5*a* and thus vary the extent of the rotation of the lever 20 about the axis 20*a* determined by the cam 18.

The lever 20 is conveniently provided in two parts, which are joined by means of an eccentric pivot 23 and a pivoting and locking screw 24. By loosening the screw 24 and turning the eccentric pivot 23 it is possible to vary the inclination of the part of the lever 20 that is connected to the thread pusher plate 14 with respect to the part that is pivoted to the supporting structure about the axis 20*a* and thus vary the stroke limit positions of the sliding motion of the block 15 along the guide 17 formed in the needle protection plate 16.

The machine is completed by thread handling elements, which are located below the supporting surface, and by another looper, or upper looper, which is arranged above the supporting surface laterally to the needle and is designed to engage the thread carried by the needle above the supporting surface and retain it while it is taken up by the lower looper, for example as disclosed and illustrated in U.S. Pat. No. 4,122,787. Said thread handling elements have not been illustrated for the sake of simplicity.

The sewing machine according to the invention operates substantially like the machine disclosed in U.S. Pat. No. 4,122,787, except that after the needle 1 has passed through the item being sewn with the thread 12, carrying below the supporting surface 3 a loop of thread 12 with a portion 12*a* that protrudes from the eye 2 of the needle 1 on the side of said needle that is directed toward the lower looper 11 and with a portion 12*b* that protrudes from the eye 2 of the needle 1 on the side of said needle that is directed toward the thread pusher plate 14, the lower looper 11 engages the portion 12*a* and the thread pusher plate 14 engages the portion 12*b* of the thread. Since both the lower looper 11 and the thread pusher plate 14 move toward the open side of the eye 2 of the needle 1, with the machine according to the invention one assuredly achieves the disengagement of the thread from the needle 1 even if the loop of thread 12 formed by the needle 1 during passage through the item 4 being sewn is tensioned.

This avoids all possibility of damage or breakage of the thread by the upper edge of the eye of the needle.

In practice it has been found that the sewing machine according to the invention fully achieves the intended aim and objects, since by achieving the assured disengagement of the thread from the eye of the needle even in the presence of tension of said thread, it allows to sew without problems even rigid materials or materials that apply high friction to the sewing thread.

The sewing machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2001A000064 from which this application claims priority are incorporated herein by reference.

What is claimed is:

1. A sewing machine for forming running-stitch seams, comprising a needle having a tip provided, and proximate to the tip, with an open eye and orientated with an axis thereof substantially perpendicular to a surface for supporting an item being sewn, said needle being actuatable with a reciprocating motion along said needle axis in order to pass cyclically through said supporting surface; a thread take-up wheel provided below said supporting surface, being arranged on a plane that is substantially parallel to said needle axis and being orientated with a wheel axis substantially perpendicular to the needle axis; said wheel being composed of a fixed part, provided with a magazine for taken-up thread, and with a rotatable part, which is rotationally actuated about said wheel axis; an actuation shaft that is rotationally actuated about a shaft axis synchronously with the motion of said needle, said rotatable part of the wheel being mounted coaxially on said actuation shaft and being provided with a lower looper adapted to engage a portion of a thread loop that protrudes from said eye along a first side of said needle; disengagement means for disengaging the thread from said needle adapted to engage a portion of the thread loop that protrudes from said eye along a second side of the needle, said disengagement means being movable to assist said lower looper for disengagement of said thread loop from the eye of the needle.

2. The sewing machine of claim 1, wherein said thread disengagement means comprises a thread pusher plate that is arranged below said supporting surface, laterally to a needle path, on an opposite side with respect to said looper.

3. The sewing machine of claim 2, further comprising a supporting element that is fixed to the supporting structure of the machine, said thread pusher plate being supported, so as to be slideable in a direction that is substantially perpendicular to the needle axis and parallel to the plane of arrangement of said wheel, by said supporting element.

4. The sewing machine of claim 3, wherein said supporting element is constituted by a needle protection plate.

5. The sewing machine of claim 3, wherein said thread pusher plate is kinematically connected to said lower looper.

6. The sewing machine of claim 5, further comprising a cam that is keyed to said actuation shaft, said thread pusher plate being connected to said cam.

7. The sewing machine of claim 6, comprising a lever that is pivoted, with an intermediate portion thereof, to said supporting structure about a lever axis that is substantially parallel to the shaft axis, said cam having a portion that is eccentric with respect to the shaft axis and being connected to said thread pusher plate by way of said lever and said lever further engaging said cam with a first end thereof and said thread pusher plate with a second end thereof.

8. The sewing machine of claim 7, further comprising distance adjustment means for adjusting a distance of said eccentric portion from the shaft axis.

9. The sewing machine of claim 7, further comprising stroke adjustment means for adjusting stroke limit positions of said thread pusher plate while sliding with respect to said supporting element.

* * * * *